US008960567B2

(12) United States Patent
Collins

(10) Patent No.: US 8,960,567 B2
(45) Date of Patent: Feb. 24, 2015

(54) SYSTEMS AND METHODS FOR PORTABLE MULTI-COMPONENT MIXING OF MATERIALS FOR SPRAY APPLICATION OF SAME

(75) Inventor: William Davis Collins, Fayetteville, AR (US)

(73) Assignee: Collins IP, LLC, Las Vegas, NV (US)

( * ) Notice: Subject to any disclaimer, the term of this patent is extended or adjusted under 35 U.S.C. 154(b) by 531 days.

(21) Appl. No.: 13/186,648

(22) Filed: Jul. 20, 2011

(65) Prior Publication Data

US 2013/0020405 A1 Jan. 24, 2013

(51) Int. Cl.

| | |
|---|---|
| ***B05B 9/00*** | (2006.01) |
| *B01F 13/00* | (2006.01) |
| *B01F 15/00* | (2006.01) |

(52) U.S. Cl.

CPC ..... *B05B 9/007* (2013.01); *B01F 13/0042* (2013.01); *B01F 15/00772* (2013.01)

USPC ..... 239/149; 239/146; 239/304; 239/128; 280/63; 280/72; 280/652

(58) Field of Classification Search

CPC ..... B05B 9/007; B08B 7/0035; B08B 7/0071

USPC ..... 239/128–139, 146–158, 302–379; 280/63, 72, 652, 655

See application file for complete search history.

(56) References Cited

U.S. PATENT DOCUMENTS

| | | | | |
|---|---|---|---|---|
| 3,194,438 | A * | 7/1965 | Walker et al. | 222/61 |
| 5,093,896 | A * | 3/1992 | Moore et al. | 392/441 |
| 6,571,805 | B2 * | 6/2003 | Hoenisch et al. | 134/22.12 |
| 8,132,693 | B2 * | 3/2012 | Choiniere et al. | 222/135 |
| 2003/0192963 | A1 * | 10/2003 | Ebberts | 239/413 |

* cited by examiner

*Primary Examiner* — Dinh Q Nguyen

(74) *Attorney, Agent, or Firm* — Triangle Patents, PLLC

(57) ABSTRACT

Methods, systems and an apparatus for multi-component mixing and spray application, including a portable, balanced frame having uniformly distributed weight over the wheels, and insulated chemical container holders for receiving replaceable materials containers therein.

16 Claims, 6 Drawing Sheets

SYSTEMS AND METHODS FOR PORTABLE MULTI-COMPONENT MIXING OF MATERIALS FOR SPRAY APPLICATION OF SAME

BACKGROUND OF THE INVENTION

1. Field of the Invention

The present invention relates to component proportioners for mixing materials, and more particularly, to portable plural component mixers for mixing materials for spray application of polyurethane and polyrea chemicals.

2. Description of the Prior Art

It is known in the relevant art to provide plural component proportioners and mixers for mixing materials including mechanical, and electromechanical versions that may be portable, i.e., including wheels for manually manipulating the proportioner to another location. Examples of relevant art publications include the following:

U.S. patent application Publication No. 2006/0071022 and PCT Publication No. WO/2004042484 for Fast Set Material Proportioner assigned according to the publication document as printed to Graco Minnesota, Inc. describing an electrically powered plural component proportioner that is transportable.

U.S. patent application Publication No. 2006/0144447 for Electronic proportioner using continuous metering and correction assigned according to the publication document as printed to Graco Minnesota, Inc. disclosing a method for dispensing materials in a plural component proportioner and illustrating a wheeled frame.

U.S. patent application Publication No. 2005/0023296 for Heated pump system for delivering multiple components in a predetermined ratio to a spray application by Bien describing a portable chemical proportioner with means for heating the chemical components, namely the use of heated hoses for application of the components, which may be drawn from chemical drums, and wherein the system may be transported on a frame that includes castors or other wheel assemblies for moving the system.

U.S. Pat. No. 4,809,909 for Plural component application system & U.S. Pat. No. 5,294,052 for Fluid dispensing system assigned according to the publication document to Glas-Craft Inc. describing a plural component application system for polyurethane applications, the system including means for heating the component materials and being mounted on a wheeled base.

U.S. patent application Publication No. 2005/0236422 for Portable apparatus for mixing and dispensing viscous materials by inventor Dutton disclosing a device for mixing and dispensing plural component materials, including at least two reservoirs for holding component materials and means for heating the materials, namely using heated hoses for dispensing components, and further describing a housing on wheels for containing the reservoirs and other aspects of the device.

U.S. Pat. No. 3,786,990 for a Plural component gun assigned according to the patent publication document to Graco Inc., by inventor Hagfors, disclosing a plural component spray gun and spraying system incorporating thermal insulated heated hoses and a support structure with a handle, bracing, and wheels that may be used to transport the system.

U.S. Pat. No. 4,332,498 for a sealant applicator invented by Lewis describing a sealant applicator for applying an elastomeric sealant made by mixing two components, and means for heating the components, and further describing a frame supported on wheels for moving the frame.

U.S. Pat. No. 6,896,152 and U.S. patent application Publication No. 2003/0015547 for Electronic plural component proportioner, assigned according to the patent document to Graco Minnesota, Inc. by inventors Pittman and Friedrich disclosing an apparatus for dispensing plural component materials illustrated as being supplied by a bucket, wherein the apparatus appears to be constructed and positioned on a wheeled platform stand.

U.S. Pat. No. 6,663,016 and U.S. patent application Publication Nos. 2003/0062427 and 2004/0227006 for an Applicator assembly for application of adhesives, sealants, and coatings assigned to Urecoats Technologies, Inc. according to the patent document by inventor Bien, describing an applicator system for melting, mixing, and applying a composition of one or more materials, and a heating system for heating components using heated hoses, the system being supported on a wheeled frame that is towable behind a vehicle.

Thus, the relevant prior art describes chemical proportioners supported by wheeled carts or frames, including dispensing or mixing systems with heated hoses.

SUMMARY OF THE INVENTION

The present invention relates to multi-component mixing devices, systems and methods therefor, which solve the problems associated with the prior art, including difficult portability due to imbalanced distribution of components of the system on the frame and wheel structure, and lack of insulation of the components, difficulty in replacing the chemical materials and heated hoses to keep the material at spray temperature.

It is an object of this invention to provide methods, systems and an apparatus for multi-component mixing and spray application, including a portable, balanced frame having uniformly distributed weight over the wheels, and insulated chemical bucket holders instead of chemical reservoir tanks, by contrast to the relevant prior art. Also, the invention makes use of heated hoses so that the chemicals stay at the precise temperature for spraying. Also, this invention can be utilizes a hose temperature control and a thermocouple temperature sensor so that the machine can be adjusted according to the material that is sprayed.

Accordingly, an embodiment of this invention is directed to an apparatus for multi-component mixing and spray application, including a portable, balanced frame having substantially symmetrically balanced and distributed weight of the insulated chemical bucket holders positioned on the frame over the wheel axle for the wheels mounted on the frame thereby.

These and other aspects of the present invention will become apparent to those skilled in the art after a reading of the following description of the preferred embodiment when considered with the drawings, as they support the claimed invention.

DETAILED DESCRIPTION

Figure 1:
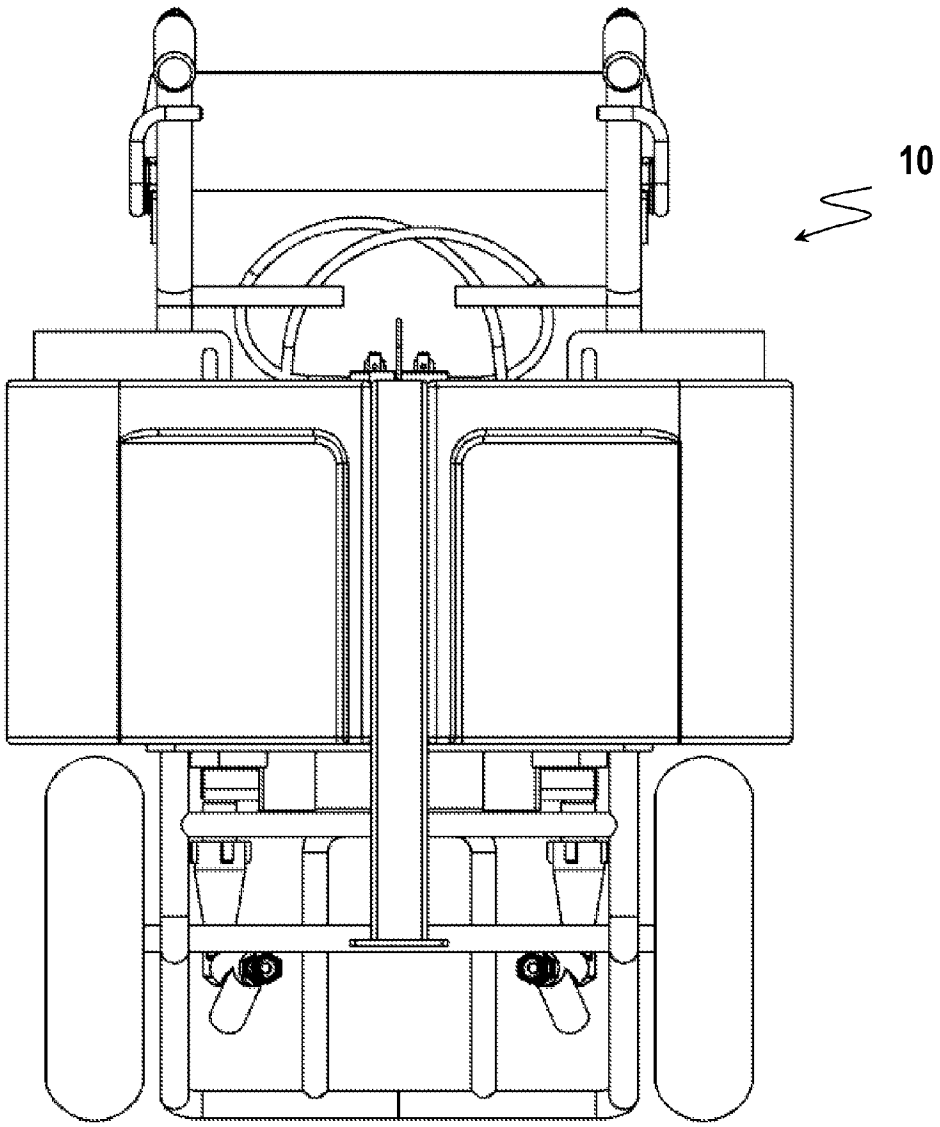
FIG. 1 is a front view diagram of one embodiment of the invention.
Figure 2:
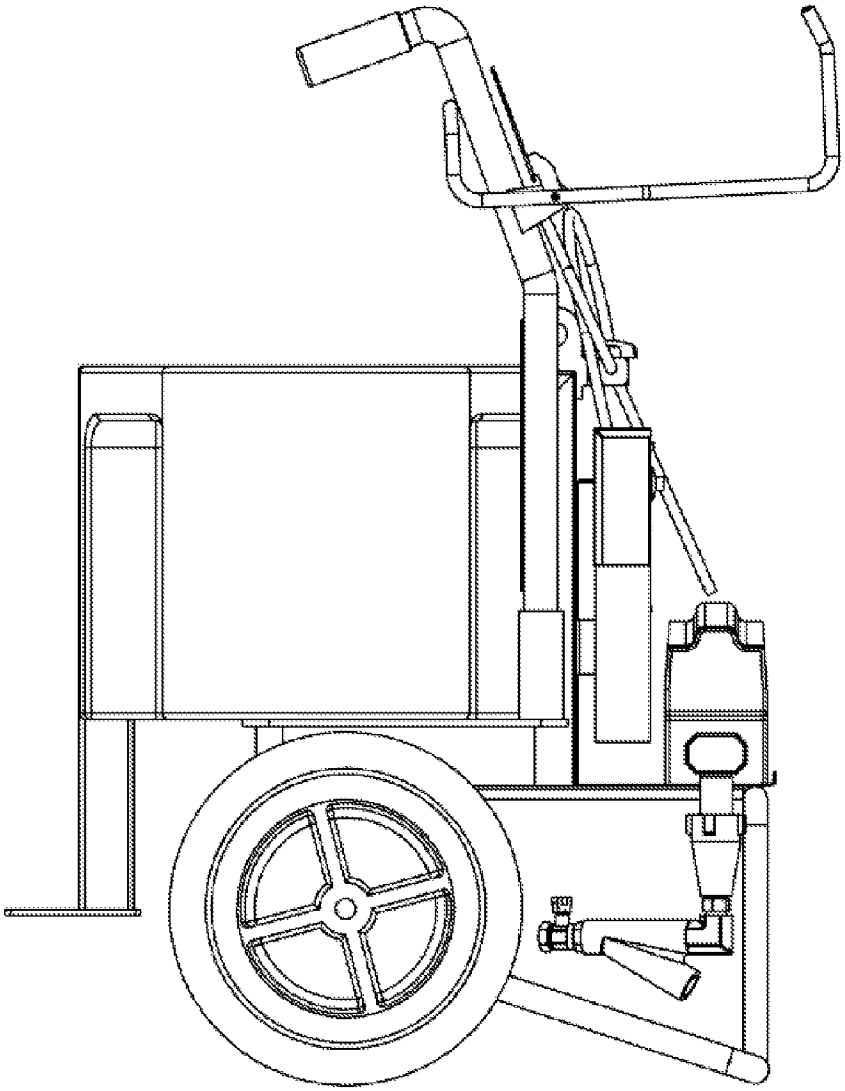
FIG. 2 is a side view diagram of the embodiment illustrated in FIG. 1.

Referring now to the drawings in general, the illustrations are for the purpose of describing a preferred embodiment of the invention and setting forth a best mode, and are not intended to limit the invention thereto. Where the same element is illustrated in the various figures, the same reference indicia are used for those elements in all the figures.

The present invention provides systems, methods, and an apparatus for portable, multi-component mixing of materials for spray application, including polyurethane and polyurea two part chemical systems.

In preferred embodiments, the system for multi-component mixing and spray application includes a portable, balanced frame assembly further including a frame having uniformly distributed weight over an axle connecting two spaced-apart wheels, and insulated chemical container holders positioned symmetrically over the axle, the holders constructed and configured for receiving replaceable materials containers therein, and for maintaining them in predetermined heated or cooled states. Also, the system is designed to have both chemical hoses connected to the container holders, with the hose being constructed and configured for dispensing the materials out of five gallon pails which can be removed out of the within the container holders. A spray gun is attached to an end of the hose opposite the container connection, thereby providing for spray application of the heated chemical material. Preferably, the hose(s) provide for proportioned mixing of the materials in predetermined amounts from the containers.

For portability and manipulation of the device, the system and its frame apparatus includes a handle bar and ergonomically positioned handles that are spaced apart from each other and positioned on the frame at a predetermined height above the container holders. Preferably, the handle bar assembly is positioned directly above and aligned with the axle, and the handles extend substantially perpendicular thereto, thereby providing for easy rotational tipping of the frame assembly about the axle of the wheels.

In preferred embodiments, and as illustrated in the figures, the container housing further includes a supporting stand protruding downwardly which provides support and stability to the assembly when it is not being transported, and to prevent rotation of the assembly in the direction of the container holders.

Figure 3:
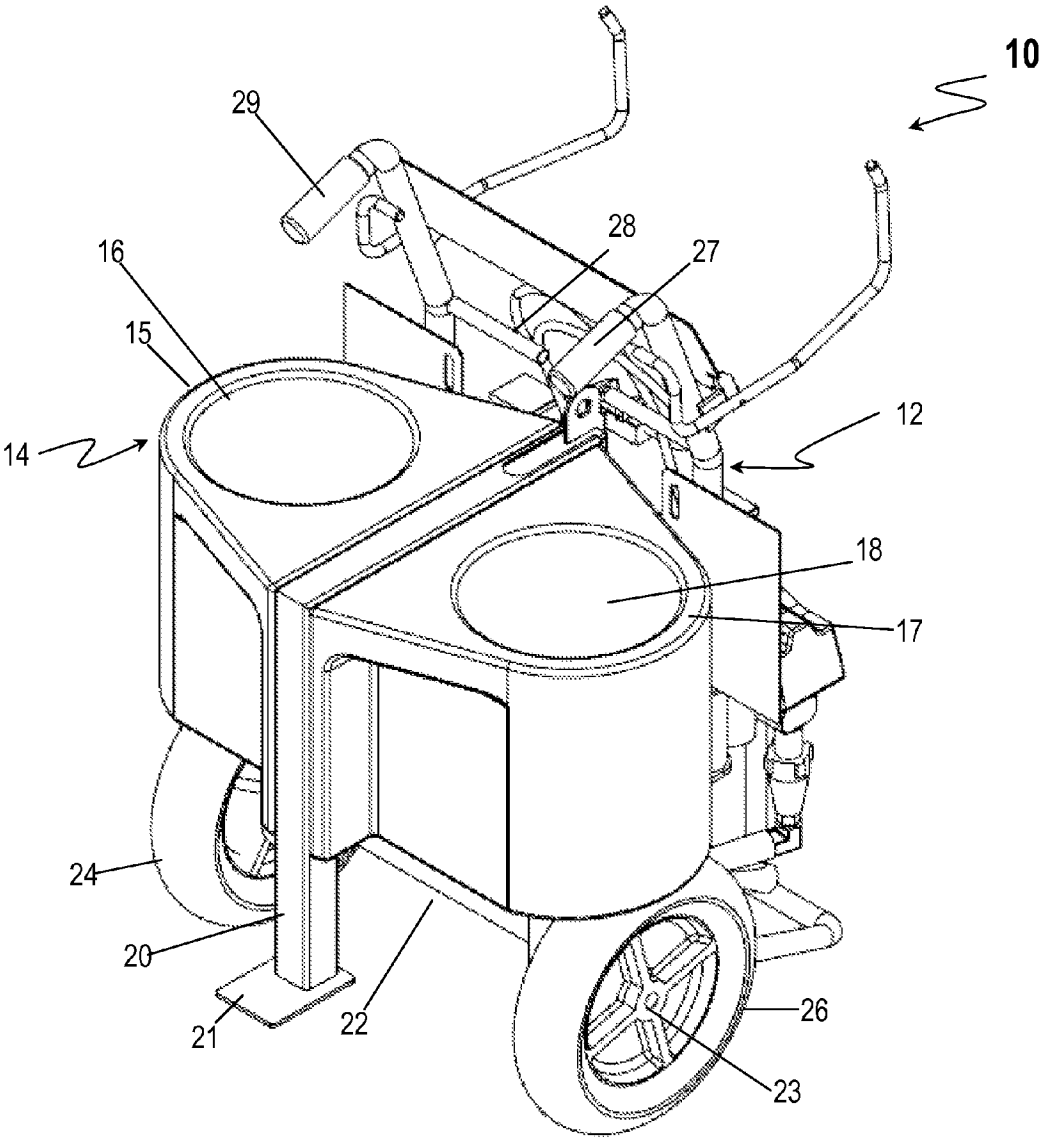
FIG. 3 is a perspective view diagram of the embodiment illustrated in FIG. 1.
Figure 4:
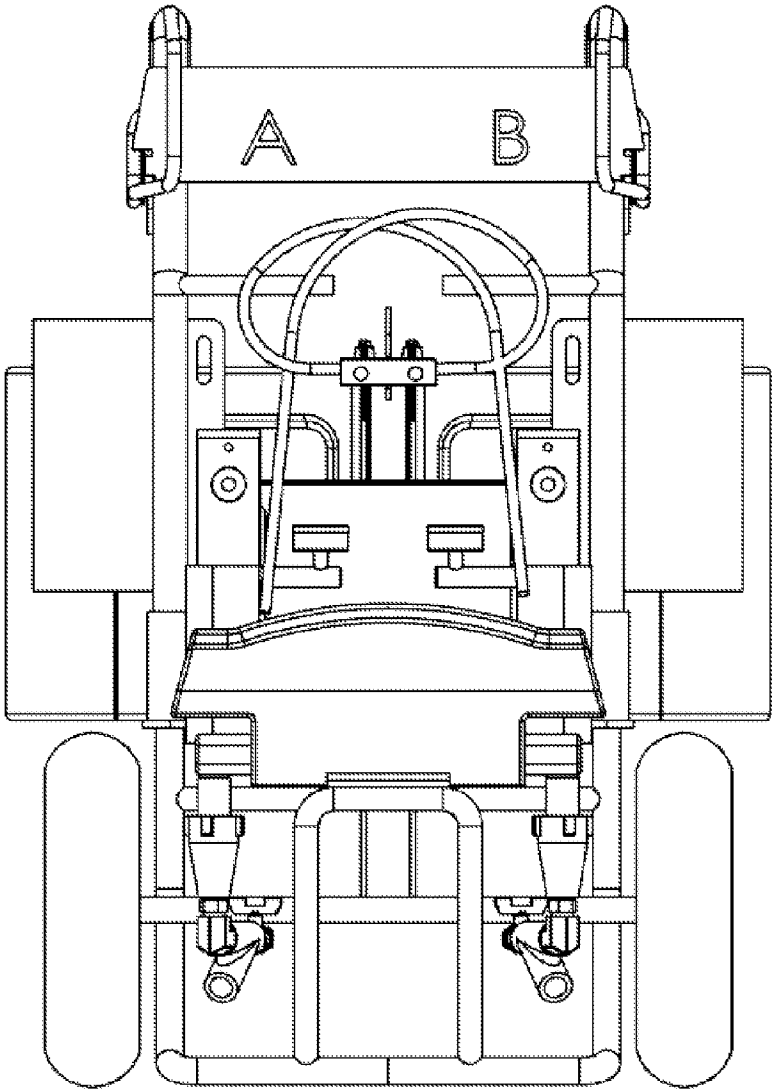
FIG. 4 is a rear view diagram of the embodiment illustrated in FIG. 1.
Figure 5:
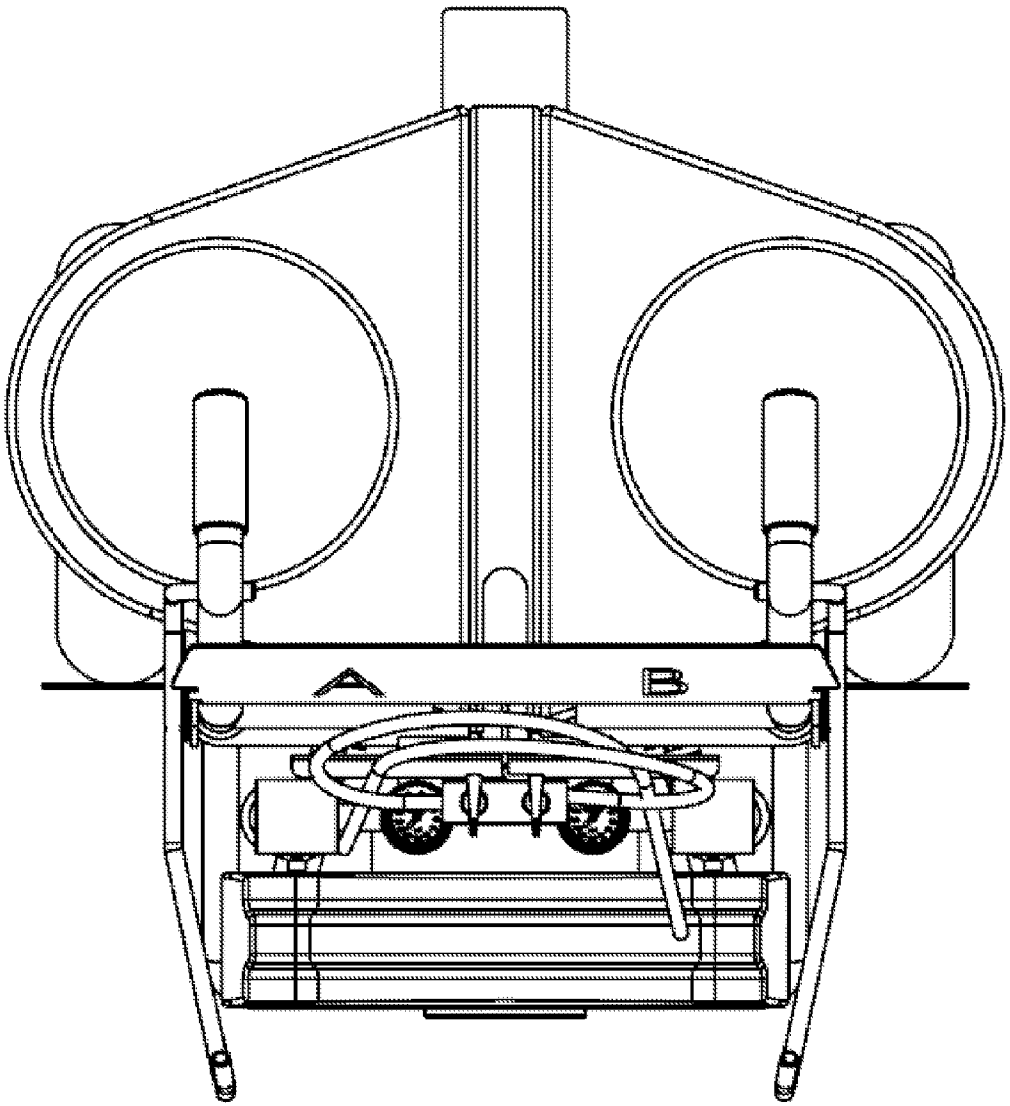
FIG. 5 shows a top view diagram of the embodiment illustrated in FIG. 1.
Figure 6:
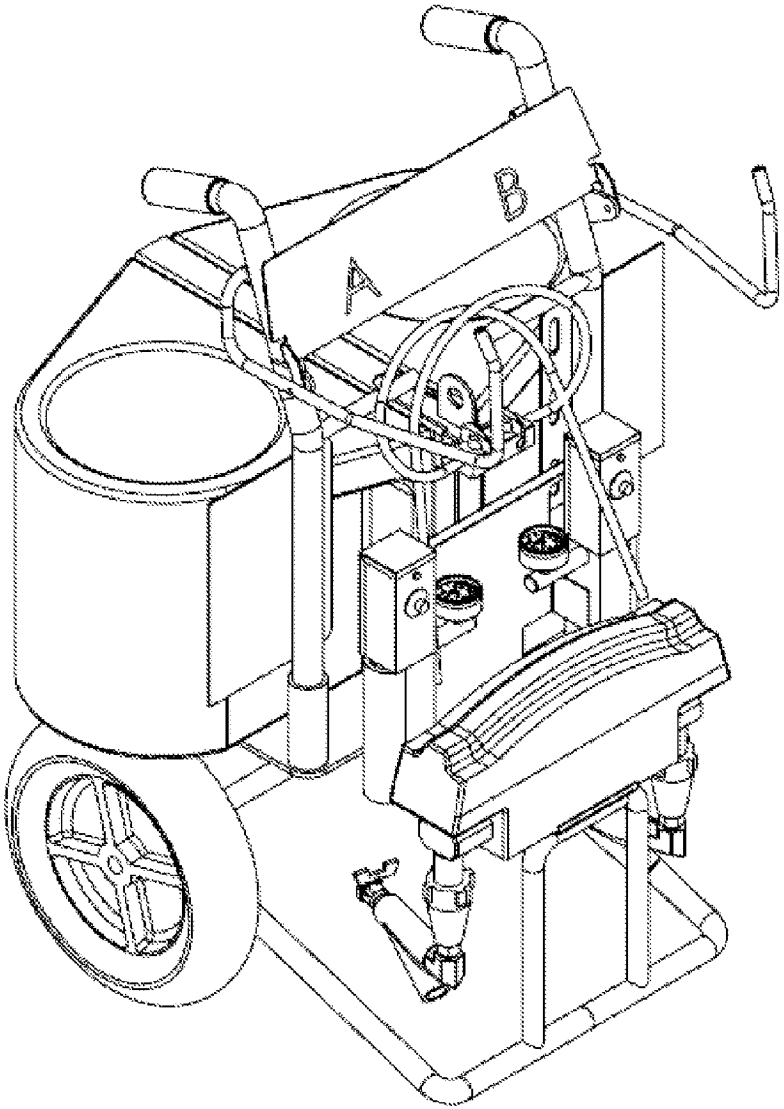
FIG. 6 illustrates a rear perspective view of the embodiment shown in FIG. 1.

Referring to FIG. 3, a perspective view of an embodiment of the present invention, generally referenced 10, is illustrated. A frame assembly 12 is provided to support the various components attached thereto, including the insulated container holders 14 having two spaced apart, generally symmetrical insulated container holder housings 16, 18 further including corresponding openings for receiving material containers therethrough 15, 17 wherein the housings have a substantially cylindrical cavity therein with insulation surrounding the cavity. And the housings are constructed and configured and attached to the frame and positioned in a balanced weight-distributed manner over the axis 23 of the axle 22 of the spaced apart wheels 24, 26 for easy portability of the system by using the spaced apart handles 27, 29 connected to the handle 28 positioned in alignment with the wheel axle axis 23 (along 22) for rotationally tipping the entire frame apparatus and all components attached thereto around the wheel axle axis. Frame support stand 21 provides support and stability for the system when not being moved, and beneficially prevents any rotation forwardly toward the container housing (i.e, the handles rotating toward the containers instead of away from them for movement). Also, beneficially, the support stand can be positioned to ensure complete emptying of the materials into the connecting hoses for spray distribution, i.e., it ensures level materials measurement indication by an indicator measuring the level of any liquid materials in the containers.

In the embodiment of an apparatus for mixing and applying multi-component materials, the following components are included: a portable, balanced frame assembly including a frame having uniformly distributed weight over an axle connecting two spaced-apart wheels, the axle connected to the lower portion of the frame, and two insulated material container holders fixedly attached to the frame and positioned substantially symmetrically over the axle, the holders having substantially cylindrical cavities disposed therein and constructed and configured for receiving replaceable materials containers therein; and a plurality of hoses connected to the container holders on a first end for supplying the materials from the containers through the hoses to corresponding spray gun at a second end of the hose(s) for spray-based application of the mixed materials; and at least one pump mechanism for moving the materials from the containers through the hoses. As with the system, the apparatus may further include a supporting bracket attached to the frame for supporting and stabilizing the apparatus and preventing rotation of the frame assembly around the wheel axle axis in the direction of the support, which is positioned opposite frame handles.

In methods of using the system and/or apparatus of the present invention, the following steps may be included for multi-component mixing and spray application, comprising the steps of: providing a portable, balanced frame assembly including a frame having uniformly distributed weight over an axle connecting two spaced-apart wheels, and insulated container holders positioned symmetrically over the axle, the holders constructed and configured for receiving replaceable materials containers therein, and for maintaining them in predetermined heated or cooled states; providing at least two materials in separate material containers positioned within the container holders; and activating pumps for pumping the materials from the containers through hoses; mixing the materials in predetermined proportions; and activating spray application of the mixed materials through a spray gun at the precise temperature required once the chemical has been delivered out of the gun. Additional steps of heating at least one of the components prior to mixing may be included as well.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

What is claimed is:

1. A system for multi-component mixing and spray application, comprising: a portable frame assembly including a frame having uniformly distributed weight over an axle connecting two spaced apart wheels, two handles, and chemical container holders positioned symmetrically completely above and over the axle; the holders constructed and configured for receiving replaceable materials containers therein, and for maintaining them in predetermined heated or cooled states; wherein the center of the holders are positioned directly above the axle; wherein the handles are positioned above the containers for rotationally pivoting the entire frame assembly and the containers around the axle without lifting the containers; and a handle bar ergonomically positioned, wherein the handles are spaced apart from each other and positioned on the frame, directly above and aligned perpendicular to the axle, at a predetermined height above the container holders.

2. The system of claim 1, further comprising hoses connected to the container holders, the hoses being constructed and configured for dispensing the materials within the containers, and wherein the replaceable materials are packaged in five gallon pails which fit into the container holders, with a spray gun attached to an end of the hoses opposite the container connection, thereby providing for spray application of the materials.

3. The system of claim 2, wherein the hoses provide for proportioned mixing of the materials in predetermined amounts.

4. The system of claim 3, wherein the proportioned mixing includes a 1 to 1 ratio between the replaceable materials of each of the containers.

5. The system of claim 1, wherein the handle bar assembly is positioned directly above and aligned with the axle, and the handles extend substantially perpendicular thereto, thereby providing for easy rotational tipping of the frame assembly about the axle of the wheels.

6. The system of claim 1, wherein the frame assembly further includes a supporting stand protruding downwardly therefrom to provide support and stability to the assembly when it is not being transported, and to prevent rotation of the assembly in the direction of the container holders.

7. The system of claim 1, further comprising a plurality of hoses connected to the container holders on a first end for supplying the materials from the containers through the hoses to a corresponding spray gun at a second end of the hose(s) for spray-based application of the mixed materials.

8. The system of claim 7, further including a supporting support attached to the frame for supporting and stabilizing the system and preventing rotation of the frame assembly around the wheel axle axis in the direction of the support, which is positioned opposite frame handles.

9. The system of claim 1, further comprising hoses connected to the container holders for dispensing the materials within the containers.

10. The system of claim 9, further comprising a spray gun attached to the end of each of the hoses opposite the container connection, thereby providing for spray application of the materials.

11. The system of claim 9, wherein the hoses provide for proportioned mixing of the materials in predetermined amounts.

12. The system of claim 11, wherein the proportioned mixing includes a 1 to 1 ratio between the replaceable materials of each of the containers.

13. The system of claim 12, wherein the containers are five gallon pails.

14. The system of claim 1, wherein the containers are five gallon pails.

15. A system for multi-component mixing and spray application, comprising:

a portable frame assembly including a frame, two handles, and chemical container holders;

wherein the frame, the handles and the holders are mirrored about the center of a length of an axle connecting two spaced apart wheels;

the holders constructed and configured for receiving replaceable materials containers therein, and for maintaining them in predetermined heated or cooled states;

wherein the center of the holders are positioned directly above the axle;

hoses connected to the container holders, the hoses being constructed and configured for dispensing replaceable materials in a mixed proportioned;

a spray gun attached to an end of the hoses opposite the container connection, thereby providing for spray application of the materials;

a handle bar ergonomically positioned, wherein the handles are spaced apart from each other and positioned on the frame, directly above and aligned perpendicular to the axle, at a predetermined height above the container holders, thereby providing for easy rotational tipping of the frame assembly about the axle of the wheels without lifting the containers.

16. A system for multi-component mixing and spray application, comprising:

a portable frame assembly including a frame, two handles, and chemical container holders;

wherein the frame, the handles and the holders are each mirrored about the center of a length of an axle connecting two spaced apart wheels;

the holders constructed and configured for receiving replaceable materials containers therein, and for maintaining them in predetermined heated or cooled states; wherein the center of the holders are positioned directly above the axle;

wherein the handles are positioned above the containers for rotationally pivoting the entire frame assembly and the containers around the axle without lifting the containers; and a handle bar ergonomically positioned, wherein the handles are spaced apart from each other and positioned on the frame, directly above and aligned perpendicular to the axle, at a predetermined height above the container holders.

* * * * *